US011111557B2

(12) United States Patent
Lee et al.

(10) Patent No.: US 11,111,557 B2
(45) Date of Patent: Sep. 7, 2021

(54) NON-ORIENTED ELECTRICAL STEEL SHEET AND MANUFACTURING METHOD THEREFOR

(71) Applicant: POSCO, Pohang-si (KR)

(72) Inventors: Hun Ju Lee, Pohang-si (KR); Yong Soo Kim, Pohang-si (KR); Su-Yong Shin, Pohang-si (KR)

(73) Assignee: POSCO, Pohang-Si (KR)

( * ) Notice: Subject to any disclaimer, the term of this patent is extended or adjusted under 35 U.S.C. 154(b) by 107 days.

(21) Appl. No.: 16/470,927

(22) PCT Filed: Dec. 19, 2017

(86) PCT No.: PCT/KR2017/015025

§ 371 (c)(1),
(2) Date: Jun. 18, 2019

(87) PCT Pub. No.: WO2018/117600

PCT Pub. Date: Jun. 28, 2018

(65) Prior Publication Data

US 2020/0087750 A1 Mar. 19, 2020

(30) Foreign Application Priority Data

Dec. 19, 2016 (KR) ..... 10-2016-0173923

(51) Int. Cl.

| | |
|---|---|
| ***C21D 9/46*** | (2006.01) |
| ***C21D 6/00*** | (2006.01) |
| ***C21D 8/00*** | (2006.01) |
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***H01F 1/147*** | (2006.01) |

(52) U.S. Cl.

CPC ..... *C21D 9/46* (2013.01); *C21D 6/005* (2013.01); *C21D 6/008* (2013.01); *C21D 8/005* (2013.01); *C21D 8/1272* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *H01F 1/14775* (2013.01); *C22C 2202/02* (2013.01)

(58) Field of Classification Search

CPC .... C21D 2201/05; C21D 6/005; C21D 6/008; C21D 8/005; C21D 8/1222; C21D 8/1233; C21D 8/1261; C21D 8/1272; C21D 9/46; C22C 2202/02; C22C 38/001; C22C 38/002; C22C 38/004; C22C 38/02; C22C 38/04; C22C 38/06; C22C 38/12; C22C 38/14; H01F 1/14775; H01F 1/16

See application file for complete search history.

(56) References Cited

U.S. PATENT DOCUMENTS

| | | | | |
|---|---|---|---|---|
| 5,045,129 | A | 9/1991 | Barisoni | |
| 2016/0273064 | A1 * | 9/2016 | Kataoka | C21D 6/005 |

FOREIGN PATENT DOCUMENTS

| | | | | |
|---|---|---|---|---|
| CN | 103834858 | A | 6/2014 | |
| CN | 104988424 | A | 10/2015 | |
| CN | 105121683 | A | 12/2015 | |
| CN | 105779729 | A | 7/2016 | |
| CN | 105908072 | A | 8/2016 | |
| JP | 2540946 | B2 | 10/1996 | |
| JP | 2005-264315 | A | 9/2005 | |
| JP | 2005-344179 | A | 12/2005 | |
| JP | 2010-024509 | A | 2/2010 | |
| JP | 2010-174376 | A | 8/2010 | |
| JP | 2013-515170 | A | 5/2013 | |
| JP | 2016-156044 | A | 9/2016 | |
| JP | 2016-194099 | A | 11/2016 | |
| KR | 10-2009-0066288 | A | 6/2009 | |
| KR | 10-2011-0075519 | A | 7/2011 | |
| KR | 20110075519 | A * | 7/2011 | |
| KR | 10-2015-0108387 | A | 9/2015 | |
| WO | 2012/141206 | A1 | 10/2012 | |
| WO | 2014-168136 | A1 | 10/2014 | |
| WO | WO-2014168136 | A1 * | 10/2014 | C22C 38/02 |

OTHER PUBLICATIONS

Extended European Search Report dated Aug. 21, 2019 issued in European Patent Application No. 17884428.8.

D. V. Hoecke, et al., "Effect of punching and stress concentrations on mechanical behaviour of electrical steels," EVS27, Barcelona, Spain, Nov. 17-20, 2013, pp. 1-6.

European Office Action dated Aug. 5, 2020 issued in European Patent Application No. 17884428.8.

Japanese Office Action dated Jul. 21, 2020 issued in Japanese Patent Application No. 2019-532750.

Chinese Office Action dated Jul. 16, 2020 issued in Chinese Patent Application No. 201780078213.8.

International Search Report and Written Opinion dated Apr. 4, 2018 issued in International Patent Application No. PCT/KR2017/015025 (with partial English translation).

* cited by examiner

*Primary Examiner* — Jenny R Wu

(74) *Attorney, Agent, or Firm* — Morgan, Lewis & Bockius LLP

(57) ABSTRACT

A non-oriented electrical steel sheet according to an embodiment of the present invention, comprises: Si: 2.0 to 3.5%, Al: 0.05 to 2.0%, Mn: 0.05 to 2.0%, In: 0.0002 to 0.003% by wt % and Fe and inevitable impurities as the remainder.

10 Claims, No Drawings

NON-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015025, filed on Dec. 19, 2017, which in turn claims the benefit of Korean Application No. 10-2016-0173923, filed on Dec. 19, 2016, the entire disclosures of which applications are incorporated by reference herein.

TECHNICAL FIELD

The present invention relates to a non-oriented electrical steel sheet and a manufacturing method thereof.

INVENTION TECHNICAL BACKGROUND

The non-oriented electrical steel sheet is mainly used in motors that convert electrical energy into mechanical energy, and in order to achieve high efficiency, non-oriented electrical steel sheet requires excellent magnetic properties. Especially in recent years, it has become very important to increase the efficiency of the motor, which accounts for more than half of the total electric energy consumption, as the environment friendly technology is attracting attention, therefore, the demand of the non-oriented electrical steel sheet having excellent magnetic properties is also increasing.

The magnetic properties of the non-oriented electrical steel sheet are typically evaluated through iron loss and magnetic flux density. Iron loss means energy loss occurring at a specific magnetic flux density and frequency, and magnetic flux density means the degree of magnetization obtained under a specific magnetic field. The lower the iron loss, the more energy efficient motors may be manufactured under the same conditions, and the higher the magnetic flux density, the smaller the motor and the copper loss may be reduced, therefore, making the non-oriented electrical steel sheet having low iron loss and high magnetic flux density is important.

Iron loss and magnetic flux density have different values depending on the measurement direction because they have anisotropy. Generally, the magnetic properties in the rolling direction are the most excellent, and when the rolling direction is rotated by 55 to 90 degrees, the magnetic properties are significantly reduced. Since the non-oriented electrical steel sheet is used in rotating equipment, lower anisotropy is advantageous for stable operation, and anisotropy can be reduced by improving the structure of the steel. When {011}<uvw> orientation or {001}<uvw> orientation develops, the average magnetism is excellent but the anisotropy is very large and when the {011}<uvw> orientation develops, the average magnetism is low and the anisotropy is small, and when the {113}<uvw> orientation develops, the average magnetism is relatively good and the anisotropy is not so great.

A commonly used method for increasing the magnetic properties of non-oriented electrical steel sheet is to add alloying elements such as Si and the like. The addition of these alloying elements may increase the specific resistance of the steel, and the higher the specific resistance, the lower the eddy current loss and the lower the total iron loss. In order to increase the specific resistance of the steel, elements such as Al and Mn and the like are added together with Si to produce a non-oriented electrical steel sheet having excellent magnetic properties.

In the case of a non-oriented electrical steel sheet used in a motor for high-speed rotation, excellent mechanical properties are required at the same time. If the rotor cannot withstand the centrifugal force generated by high-speed rotation, the motor may be damaged, so a high yield strength is required in various operating environments. In general, however, crystal grain refinement, precipitation, phase transformation and the like for obtaining excellent mechanical properties greatly degrade the magnetic properties of the non-oriented electrical steel sheet, so that it is very difficult to satisfy both the magnetic properties and the mechanical properties at the same time. If the temperature rises while the motor operates, the yield strength of the non-oriented electrical steel sheet is lowered, and maintaining the excellent mechanical properties at high temperatures is also a property of the non-oriented electrical steel sheet should have.

CONTENTS OF THE INVENTION

Problem to Solve

An embodiment of the present invention provides a non-oriented electrical steel sheet and a method of manufacturing the same. Specifically, it provides a non-oriented electrical steel sheet having both excellent magnetic properties and mechanical properties at the same time.

Technical Solution

A non-oriented electrical steel sheet according to an embodiment of the present invention comprises Si: 2.0 to 3.5%, Al: 0.05 to 2.0%, Mn: 0.05 to 2.0%, In: 0.0002 to 0.003% by wt % and Fe and inevitable impurities as the remainder.

The non-oriented electrical steel sheet may further comprise Bi: 0.0005 to 0.05% by wt %.

The non-oriented electrical steel sheet may further comprise least one of C: 0.005 wt % or less, S: 0.005 wt % or less, N: 0.004 wt % or less, Ti: 0.004 wt % or less, Nb: 0.004 wt % or less, and V: 0.004 wt % or less.

The non-oriented electrical steel sheet may further comprise least one of B: 0.001 wt % or less, Mg: 0.005 wt % or less, Zr: 0.005 wt % or less, and Cu: 0.025 wt % or less.

The non-oriented electrical steel sheet may comprise 20% or less of crystal grains having a crystal orientation with respect to a cross section which is perpendicular to the rolling direction of a steel sheet has an orientation within 15 degrees from {111}<uvw>. The $YP_{0.2}$ obtained when the tensile test is subjected at 120° C. may be 0.7 times or more of the $YP_{0.2}$ obtained when the tensile test is subjected at 20° C.

(the $YP_{0.2}$ means offset yield strength in the stress-strain graph obtained through the tensile test.)

The iron loss ($W_{15/50}$) may be 2.30 W/kg or less, and a magnetic flux density ($B_{50}$) may be 1.67 T or more.

A method for manufacturing a non-oriented electrical steel sheet according to an embodiment of the present invention comprises: heating a slab comprising Si: 2.0 to 3.5%, Al: 0.05 to 2.0%, Mn: 0.05 to 2.0%, In: 0.0002 to 0.003% by wt % and Fe and inevitable impurities as the remainder; performing hot rolling on the slab to manufacture a hot rolled sheet; performing cold rolling on the hot rolled sheet to manufacture a cold rolled sheet; and performing final annealing on the cold rolled sheet.

The slab may further comprise 0.0005 to 0.05 wt % of Bi.

The slab may further comprise at least one of C: 0.005 wt % or less, S: 0.005 wt % or less, N: 0.004 wt % or less, Ti: 0.004 wt % or less, Nb: 0.004 wt % or less, and V: 0.004 wt % or less.

The method may further comprise at least one of B: 0.001 wt % or less, Mg: 0.005 wt % or less, Zr: 0.005 wt % or less, and Cu: 0.025 wt % or less.

The step of performing hot rolled sheet annealing on the hot rolled sheet may further comprise after the step of manufacturing a hot rolled sheet.

Effects of the Invention

The non-oriented electrical steel sheet and the manufacturing method according to an embodiment of the present invention are excellent both in magnetic properties and mechanical properties at the same time.

DETAILED DESCRIPTION OF THE INVENTION

The first term, second and third term, etc. are used to describe various parts, components, regions, layers and/or sections, but are not limited thereto. These terms are only used to distinguish any part, component, region, layer or section from other part, component, region, layer or section. Therefore, the first part, component, region, layer or section may be referred to as the second part, component, region, layer or section within the scope unless excluded from the scope of the present invention.

The terminology used herein is only to refer specific embodiments and is not intended to be limiting of the invention. The singular forms used herein comprise plural forms as well unless the phrases clearly indicate the opposite meaning. The meaning of the term "comprise" is to specify a particular feature, region, integer, step, operation, element and/or component, not to exclude presence or addition of other features, regions, integers, steps, operations, elements and/or components.

It will be understood that when an element such as a layer, coating, region, or substrate is referred to as being "on" another element, it can be directly on the other element or intervening elements may also be present. In contrast, when an element is referred to as being "directly on" another element, there are no intervening elements present.

Although not defined differently, every term comprising technical and scientific terms used herein have the same meaning as commonly understood by those who is having ordinary knowledge of the technical field to which the present invention belongs. The commonly used predefined terms are further interpreted as having meanings consistent with the relevant technology literature and the present content and are not interpreted as ideal or very formal meanings unless otherwise defined.

In addition, unless otherwise stated, % means wt %, and 1 ppm is 0.0001 wt %

In an embodiment of the present invention, the meaning further comprising additional elements means that the remainder (Fe) is replaced by additional amounts of the additional elements.

Hereinafter, embodiments of the present invention will be described in detail so that those skilled in the art may easily carry out the present invention. The present invention may, however, be implemented in several different forms and is not limited to the embodiments described herein.

In an embodiment of the present invention, the composition of the non-oriented electrical steel sheet, in particular, the range of Si, Al and Mn, which are the main additive components, is optimized, and in addition, it is possible to provide a non-oriented electrical steel sheet having both excellent magnetic properties and mechanical properties by improving the high temperature strength and suppressing the oxidation layer by adding an appropriate amount of In.

A non-oriented electrical steel sheet according to an embodiment of the present invention comprises Si: 2.0 to 3.5%, Al: 0.05 to 2.0%, Mn: 0.05 to 2.0%, In: 0.0002 to 0.003% and Fe and inevitable impurities as the remainder.

First, the reason for limiting the components of the non-oriented electrical steel sheet will be described.

Si: 2.0 to 3.5 wt %

Silicon (Si) serves to lower the iron loss by increasing the specific resistance of the material, and if it is added too little, the effect of improving the high-frequency iron loss may be insufficient. On the other hand, if it is excessively added, the hardness of the material increases, and the cold rolling property is extremely deteriorated, so that the productivity and punching property may become inferior. Therefore, Si may be added in the above-mentioned range.

Al: 0.05 to 2.0 wt %

Aluminum(Al) serves to lower the iron loss by increasing the specific resistance of the material, and if it is added too little, if is added less, it is not effective to reduce iron loss. On the other hand, if it is excessively added, excessive nitrides may be formed to deteriorate the magnetic properties, which may cause problems in all processes such as steelmaking and continuous casting, thereby greatly lowering the productivity. Therefore, Al may be added in the above-mentioned range.

Mn: 0.05 to 2.0 wt %

Manganese (Mn) serves to improve the iron loss and to form the sulfide by increasing the specific resistance of the material, and if it is added too little, MnS may precipitate finely and deteriorate the magnetic property. On the other hand, if it is excessively added, magnetic flux density may be reduced by promoting the formation of [111] structure which is disadvantageous to the magnetic property. Therefore, Mn may be added in the above-mentioned range.

In: 0.0002 to 0.003 wt %

Indium (In) serves to suppress the oxide layer and improve the high temperature strength by segregating on the surface and grain boundaries of the steel sheet. When In is comprised in an appropriate amount, the strength of the grain boundary is increased, and the decrease of the yield strength can be suppressed even if the temperature rises to near 100° C. If In is comprised too small, the effect is insignificant, and if it is comprised too much, a problem of lowering the grain boundary strength may occur. Therefore, In may be added in the above-mentioned range.

Bi: 0.0005 to 0.05 wt %

Bismuth (Bi) serves to suppress the oxide layer and improve the structure by segregating on the surface and grain boundaries of the steel sheet. When Bi is comprised in an appropriate amount, since the effect of lowering the grain boundary energy is high, intergranular recrystallization is suppressed and the recrystallized grain fraction having a {111}<uvw> orientation is lowered. If Bi is comprised too small, the effect is insignificant, and if it is comprised too much, the grain growth inhibition, the surface property deterioration and the brittleness increase, so the magnetic and mechanical properties may be deteriorated at the same time. Therefore, Bi may be added in the above-mentioned range.

C: 0.005 wt % or less

Carbon (C) causes magnetic aging and combines with other impurity elements to generate carbides, thereby lowering the magnetic properties, thus it is preferable to contain the lower the content. When C is comprised, it may be comprised at 0.005 wt % or less. More preferably, it may be comprised at 0.003 wt % or less.

S: 0.005 wt % or less

Sulfur(S) is an element inevitably present in the steel, and forms fine precipitates such as MnS, CuS and the like, thereby deteriorating magnetic properties. When S is comprised, it may be comprised at 0.005 wt % or less. More preferably, it may be comprised at 0.003 wt % or less.

N: 0.004 wt % or less

Nitrogen(N) not only forms fine and long AlN precipitates inside the base material but also forms fine mixtures by binding with other impurities to suppress crystal growth and deteriorate iron loss, thus it is preferable to contain the lower the content. When N is comprised, it may be comprised at 0.004 wt % or less. More preferably, it may be comprised at 0.003 wt % or less.

Ti, Nb, V: 0.004 wt % or less respectively

Titanium(Ti), niobium(Nb) and vanadium(V) may be comprised in an amount of 0.004 wt % or less since they form carbides or nitrides to deteriorate iron loss and promote undesirable {111} structure development in magnetism. More preferably, it may be comprised at 0.003 wt % or less.

Other Elements

In addition to the above-mentioned elements, inevitably entrained impurities such as B, Mg, Zr, Cu and the like may be comprised. Although these elements are trace amounts, they may cause deterioration of magnetic property through formation of inclusions in the steel and the like, it must be managed to B: 0.001 wt % or less, Mg: 0.005 wt % or less, Zr: 0.005 wt % or less, Cu: 0.025 wt % or less.

As described above, the non-oriented electrical steel sheet according to an embodiment of the present invention can precisely control the components, thereby minimizing the crystal structure adversely affecting the magnetic properties. Specifically, the non-oriented electrical steel sheet may comprise 20% or less of crystal grains having a crystal orientation with respect to a cross section which is perpendicular to the rolling direction of a steel sheet has an orientation within 15 degrees from {111}<uvw>. In an embodiment of the present invention, the content of the crystal grains means the area fraction of the crystal grains with respect to the total area when the cross section of the steel sheet is measured by EBSD. The EBSD is a method of calculating the bearing fraction by measuring the cross section of a steel sheet including the entire thickness layer by an area of 15 $mm^2$ or more.

As described above, by precisely controlling the components, a non-oriented electrical steel sheet excellent in magnetic properties and excellent in mechanical properties at the same time may be obtained. First, the mechanical properties, the $YP_{0.2}$ obtained when the tensile test is performed at 120° C. may be 0.7 times or more of the $YP_{0.2}$ obtained when the tensile test is performed at 20° C. In this case, the $YP_{0.2}$ means offset yield strength in the stress-strain graph obtained through the tensile test. Means that the $YP_{0.2}$ obtained when the tensile test is performed at 120° C. is 0.7 times or more of the $YP_{0.2}$ obtained when the tensile test is performed at 20° C. means that when the motor made of the non-oriented electrical steel sheet by an embodiment of the present invention actually operates and the temperature rises to 120° C., the yield strength decrease rate is less than 30%, which means that the mechanical properties are excellent even when the actual motor is operated. Specifically, the $YP_{0.2}$ obtained when the tensile test is performed at 120° C. may be 250 to 350 Mpa, and the $YP_{0.2}$ obtained when the tensile test is performed at 20° C. may be 330 to 450 MPa.

Next, the magnetic property may be an iron loss($W_{15/50}$) of 2.30 W/kg or less and a magnetic flux density($B_{50}$) of 1.67 T or more. More specifically, the iron loss($W_{15/50}$) may be 2.0 to 2.30 W/kg and the magnetic flux density($B_{50}$) may be 1.67 to 1.70 T.

A method for manufacturing a non-oriented electrical steel sheet according to an embodiment of the present invention comprises heating a slab comprising Si: 2.0 to 3.5%, Al: 0.05 to 2.0%, Mn: 0.05 to 2.0%, In: 0.0002 to 0.003% by wt % and Fe and inevitable impurities as the remainder; performing hot rolling on the slab to manufacture a hot rolled sheet; performing cold rolling on the hot rolled sheet to manufacture a cold rolled sheet; and performing final annealing on the cold rolled sheet. Hereinafter, each step will be described in detail.

First, the slab is heated. Since the reason why the addition ratio of each composition in the slab is limited is the same as the reason for limiting the composition of the non-oriented electrical steel sheet which is mentioned above, the repeated description is omitted. The composition of the slab is substantially the same as that of the non-oriented electrical steel sheet since it does not substantially change during the manufacturing process such as hot rolling, annealing hot rolled sheet, cold rolling and final annealing and the like which will be described later.

The slab is inserted into a heating furnace and heated at 1100 to 1250° C. If heated at a temperature which is exceeding 1250° C., the precipitate is dissolved again and may be precipitated finely after hot rolling.

The heated slab is hot rolled to 2 to 2.3 mm and manufactured a hot rolled sheet. In the step of manufacturing the hot rolled sheet, the finishing temperature may be 800 to 1000° C. After the step of manufacturing the hot rolled sheet, the step of annealing the hot rolled sheet may be further comprised. In this case, annealing temperature of the hot rolled sheet may be 850 to 1150° C. If the annealing temperature of the hot rolled sheet is less than 850° C., the structure does not grow or grows finely that the synergistic effect of the magnetic flux density is small if the annealing temperature exceeds 1150° C., the magnetic property is rather deteriorated, and the hot workability may get worse due to the deformation of the sheet shape.

More specifically, the temperature range may be 950 to 1125° C. More specifically, the annealing temperature of the hot rolled sheet may be 900 to 1100° C. The hot rolled sheet annealing is performed to increase the orientation favorable to magnetic property as necessary and may be omitted.

Next, the hot rolled sheet is pickled and cold rolled to be a predetermined sheet thickness. However, it may be applied depending on the thickness of the hot rolled sheet, it may be cold rolled to a final thickness of 0.2 to 0.65 mm by applying a percentage reduction in thickness of 70 to 95%.

The cold rolled sheet which is final cold rolled is subjected to final annealing. The final annealing temperature may be 750 to 1050° C. If the final annealing temperature is too low, recrystallization does not occur sufficiently, and if the final annealing temperature is too high, the rapid growth of crystal grains occurs, and magnetic flux density and high-frequency iron loss may become inferior. More specifically, it may be subjected to final annealing at a temperature of 900 to 1000° C. In the final annealing process, all the processed structure formed in the cold rolling step which is the previous step may be recrystallized (i.e., 99% or more). The average grain size of the crystal grains of the final annealed steel sheet may be 50 to 150 μm.

Hereinafter, the present invention will be described in more detail with reference to examples. However, these examples are only for illustrating the present invention, and the present invention is not limited thereto.

EXAMPLE

A slab comprising Fe and inevitable impurities as the remainder was prepared as shown in Table 1 below. The slab was heated at 1140° C., and finishing hot rolled at 880° C. to produce the hot rolled sheet having thickness of 2.3 mm. The hot-rolled hot rolled sheet was subjected to hot rolled sheet annealing at 1030° C. for 100 seconds, and then pickling and cold rolling to 0.35 mm thickness, and final annealing at 1000° C. for 110 seconds.

The magnetic flux density($B_{50}$), iron loss($W_{15/50}$) and {111} orientation fraction (%) for each specimen are shown in Table 2 below. The magnetic properties such as magnetic flux density, iron loss and the like were measured by Epstein tester after cutting specimens of width 30 mm× length 305 mm×20 pieces for each specimen. In this case, $B_{50}$ is a magnetic flux density induced at a magnetic field of 5000 A/m, and $W_{15/50}$ means an iron loss when a magnetic flux density of 1.5 T is induced at a frequency of 50 Hz.

The {111} orientation fraction was measured 10 times so as not to be overlapped by applying a 350 μm×5000 μm area and a 2 μm step interval to the perpendicular cross section including all of the thickness layer of the specimen, and the {111}<uvw> orientation fraction bearing within the error range of 15 degrees is calculated by merging the data.

The yield strength was measured by a tensile test, and the tensile test specimens were prepared in accordance with JIS No. 5, and were measured by tensile-deforming the specimens at a rate of 20 mm/min. The 120° C. tensile test was carried out by placing a heating chamber around the specimen after mounting the specimen to the test machine, and when the temperature reached 120° C., the tensile test was performed at the same strain rate of 20 mm/min after waiting for 5 minutes.

TABLE 1

| Specimen No. | Si (%) | Al (%) | Mn (%) | In (%) | Bi (%) | C (%) | S (%) | N (%) | Ti (%) | Nb (%) | V (%) |
|---|---|---|---|---|---|---|---|---|---|---|---|
| A1 | 2.50 | 0.75 | 1.80 | 0 | 0 | 0.0024 | 0.0011 | 0.0013 | 0.0009 | 0.0016 | 0.0016 |
| A2 | 2.50 | 0.75 | 1.80 | 0.0051 | 0.0720 | 0.0021 | 0.0012 | 0.0019 | 0.0010 | 0.0014 | 0.0014 |
| A3 | 2.50 | 0.75 | 1.80 | 0.0005 | 0.0010 | 0.0023 | 0.0009 | 0.0012 | 0.0014 | 0.0011 | 0.0011 |
| A4 | 2.50 | 0.75 | 1.80 | 0.0027 | 0.0410 | 0.0029 | 0.0013 | 0.0009 | 0.0013 | 0.0012 | 0.0012 |
| B1 | 2.60 | 1.50 | 0.30 | 0 | 0 | 0.0023 | 0.0012 | 0.0015 | 0.0017 | 0.0014 | 0.0011 |
| B2 | 2.60 | 1.50 | 0.30 | 0.0062 | 0.0560 | 0.0021 | 0.0011 | 0.0021 | 0.0017 | 0.0011 | 0.0011 |
| B3 | 2.60 | 1.50 | 0.30 | 0.0019 | 0.0370 | 0.0024 | 0.0013 | 0.0017 | 0.0012 | 0.0013 | 0.0013 |
| B4 | 2.60 | 1.50 | 0.30 | 0.0015 | 0.0079 | 0.0021 | 0.0019 | 0.0017 | 0.0014 | 0.0019 | 0.0009 |
| C1 | 3.00 | 1.20 | 0.05 | 0.0021 | 0.0870 | 0.0021 | 0.0012 | 0.0019 | 0.0012 | 0.0014 | 0.0013 |
| C2 | 3.00 | 1.20 | 0.05 | 0.0035 | 0.0340 | 0.0023 | 0.0014 | 0.0021 | 0.0017 | 0.0012 | 0.0012 |
| C3 | 3.00 | 1.20 | 0.05 | 0.0008 | 0.0135 | 0.0024 | 0.0012 | 0.0022 | 0.0014 | 0.0011 | 0.0011 |
| C4 | 3.00 | 1.20 | 0.05 | 0.0023 | 0.0290 | 0.0021 | 0.0010 | 0.0018 | 0.0014 | 0.0017 | 0.0007 |
| D1 | 3.50 | 0.05 | 1.20 | 0 | 0.0310 | 0.0021 | 0.0014 | 0.0014 | 0.0014 | 0.0019 | 0.0009 |
| D2 | 3.50 | 0.05 | 1.20 | 0.0017 | 0 | 0.0023 | 0.0011 | 0.0011 | 0.0013 | 0.0014 | 0.0014 |
| D3 | 3.50 | 0.05 | 1.20 | 0.0012 | 0.0247 | 0.0024 | 0.0007 | 0.0018 | 0.0014 | 0.0019 | 0.0009 |
| D4 | 3.50 | 0.05 | 1.20 | 0.0024 | 0.0036 | 0.0021 | 0.0009 | 0.0011 | 0.0013 | 0.0014 | 0.0014 |

TABLE 2

| Specimen No. | $B_{50}$ (T) | $W_{15/50}$ (W/kg) | {111} orientation fraction (%) | YP0.2 at 20° C. [A] (MPa) | YP0.2 at 120° C. [B] (MPa) | B/A | Remarks |
|---|---|---|---|---|---|---|---|
| A1 | 1.64 | 2.43 | 23 | 340 | 230 | 0.68 | Comparative Example |
| A2 | 1.64 | 2.48 | 24 | 340 | 220 | 0.65 | Comparative Example |
| A3 | 1.67 | 2.17 | 17 | 340 | 270 | 0.79 | Inventive Example |
| A4 | 1.67 | 2.17 | 18 | 345 | 260 | 0.75 | Inventive Example |
| B1 | 1.66 | 2.41 | 23 | 350 | 225 | 0.64 | Comparative Example |
| B2 | 1.66 | 2.44 | 25 | 360 | 230 | 0.64 | Comparative Example |
| B3 | 1.68 | 2.15 | 16 | 355 | 260 | 0.73 | Inventive Example |
| B4 | 1.68 | 2.16 | 17 | 350 | 280 | 0.80 | Inventive Example |
| C1 | 1.66 | 2.42 | 25 | 395 | 270 | 0.68 | Comparative Example |
| C2 | 1.66 | 2.46 | 24 | 400 | 260 | 0.65 | Comparative Example |
| C3 | 1.68 | 2.17 | 18 | 400 | 310 | 0.78 | Inventive Example |

TABLE 2-continued

| Specimen No. | $B_{50}$ (T) | $W_{15/50}$ (W/kg) | {111} orientation fraction (%) | YP0.2 at 20° C. [A] (MPa) | YP0.2 at 120° C. [B] (MPa) | B/A | Remarks |
|---|---|---|---|---|---|---|---|
| C4 | 1.68 | 2.16 | 18 | 400 | 320 | 0.80 | Inventive Example |
| D1 | 1.65 | 2.45 | 26 | 430 | 280 | 0.65 | Comparative Example |
| D2 | 1.65 | 2.46 | 25 | 425 | 285 | 0.67 | Comparative Example |
| D3 | 1.68 | 2.16 | 18 | 425 | 340 | 0.80 | Inventive Example |
| D4 | 1.68 | 2.17 | 17 | 420 | 320 | 0.76 | Inventive Example |

As shown in Table 1 and Table 2, A3, A4, B3, B4, C3, C4, D3 and D4 corresponding to the range of the present invention was excellent in magnetic properties, had a {111} orientation fraction of 20% or less, and satisfied all B/A of 0.7 or more. On the other hand, A1, A2, B1, B2, C1, C2, D1, and D2 whose In and Bi contents are out of the range of the present invention were all poor in magnetic properties, had a {111} orientation fraction exceeding 20%, and had B/A value of less than 0.7, founding that the mechanical properties at high temperatures were rapidly deteriorated.

The present invention is not limited to the above-mentioned examples or embodiments and may be manufactured in various forms, those who have ordinary knowledge of the technical field to which the present invention belongs may understand that it may be carried out in different and concrete forms without changing the technical idea or fundamental feature of the present invention. Therefore, the above-mentioned examples or embodiments are illustrative in all aspects and not limitative.

What is claimed is:

1. A non-oriented electrical steel sheet, comprising:

Si: 2.0 to 3.5%, Al: 0.05 to 2.0%, Mn: 0.05 to 2.0%, In: 0.0002 to 0.003%, Bi: 0.0005 to 0.05 by wt % and Fe and inevitable impurities as the remainder.

2. The non-oriented electrical steel sheet of claim 1, further comprising at least one of C: 0.005 wt % or less, S: 0.005 wt % or less, N: 0.004 wt % or less, Ti: 0.004 wt % or less, Nb: 0.004 wt % or less, and V: 0.004 wt % or less.

3. The non-oriented electrical steel sheet of claim 1, further comprising at least one of B: 0.001 wt % or less, Mg: 0.005 wt % or less, Zr: 0.005 wt % or less, and Cu: 0.025 wt % or less.

4. The non-oriented electrical steel sheet of claim 1, comprising

20% or less of crystal grains having a crystal orientation with respect to a cross section which is perpendicular to the rolling direction of a steel sheet has an orientation within 15 degrees from {111}<uvw>.

5. The non-oriented electrical steel sheet of claim 1, wherein the YP0.2 obtained when the tensile test is subjected at 120° C. is 0.7 times or more of the YP0.2 obtained when the tensile test is subjected at 20° C., the YP0.2 means offset yield strength in the stress-strain graph obtained through the tensile test.

6. The non-oriented electrical steel sheet of claim 1, wherein an iron loss $W_{15/50}$ is 2.30 W/kg or less, and a magnetic flux density $B_{50}$ is 1.67 T or more.

7. A method for manufacturing a non-oriented electrical steel sheet comprising:

heating a slab comprising Si: 2.0 to 3.5%, Al: 0.05 to 2.0%, Mn: 0.05 to 2.0%, In: 0.0002 to 0.003%, Bi: 0.0005 to 0.05 by wt % and Fe and inevitable impurities as the remainder;

performing hot rolling on a slab to manufacture a hot rolled sheet;

performing cold rolling on the hot rolled sheet to manufacture a cold rolled sheet; and performing final annealing on the cold rolled sheet, thereby producing the non-oriented electrical steel sheet of claim 1.

8. The method of claim 7, wherein the slab further comprises at least one of C: 0.005 wt % or less, S: 0.005 wt % or less, N: 0.004 wt % or less, Ti: 0.004 wt % or less, Nb: 0.004 wt % or less, and V: 0.004 wt % or less.

9. The method of claim 8, further comprising the slab further comprises at least one of B: 0.001 wt % or less, Mg: 0.005 wt % or less, Zr: 0.005 wt % or less, and Cu: 0.025 wt % or less.

10. The method of claim 8, further comprising performing hot rolled sheet annealing on the hot rolled sheet after the step of manufacturing a hot rolled sheet.

* * * * *